US010162300B2

(12) United States Patent
Tokumoto et al.

(10) Patent No.: US 10,162,300 B2
(45) Date of Patent: Dec. 25, 2018

(54) IMAGE FORMING APPARATUS

(71) Applicant: CANON KABUSHIKI KAISHA, Tokyo (JP)

(72) Inventors: Masayuki Tokumoto, Kashiwa (JP); Hiromichi Koseki, Saitama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/599,536

(22) Filed: May 19, 2017

(65) Prior Publication Data

US 2017/0343952 A1 Nov. 30, 2017

(30) Foreign Application Priority Data

May 27, 2016 (JP) ..... 2016-106744

(51) Int. Cl.
*G03G 15/00* (2006.01)
*G03G 21/16* (2006.01)
*G03G 15/04* (2006.01)

(52) U.S. Cl.
CPC ..... *G03G 15/80* (2013.01); *G03G 15/04* (2013.01); *G03G 21/1604* (2013.01); *G03G 21/1652* (2013.01); *G03G 21/1661* (2013.01)

(58) Field of Classification Search
CPC ..... G03G 21/1614; G03G 21/1652; G03G 21/1604; G03G 21/1619; G03G 21/1642; G03G 21/1661; G03G 15/80
See application file for complete search history.

(56) References Cited

U.S. PATENT DOCUMENTS

2013/0283944 A1* 10/2013 Koyanagi ..... B41J 13/14 74/89.18
2016/0085200 A1* 3/2016 Fujita ..... G03G 15/80 399/90
2016/0295047 A1* 10/2016 Shigeno ..... H04N 1/00795

FOREIGN PATENT DOCUMENTS

JP 2002043766 A * 2/2002
JP 2012-234102 A 11/2012
JP 2016062006 A * 4/2016 ..... G03G 15/80

OTHER PUBLICATIONS

Machine Translation of JP 2012-234102. Nov. 29, 2012.*

* cited by examiner

*Primary Examiner* — Carla Therrien
(74) *Attorney, Agent, or Firm* — Venable LLP

(57) ABSTRACT

An image forming apparatus includes an apparatus main assembly, a controller provided in the apparatus main assembly, an operating portion mounted to the apparatus main assembly, a cable configured to electrically connect the controller and the operating portion, the cable having a connectable length with the operating portion mounted at a predetermined position, and an accommodating portion provided in the apparatus main assembly and configured to accommodate an excessive length portion of the cable connected with the operating portion mounted to the apparatus main assembly, the accommodating portion including a space for accommodating the cable in a wound state.

17 Claims, 7 Drawing Sheets

IMAGE FORMING APPARATUS

FIELD OF THE INVENTION AND RELATED ART

The present invention relates to an image forming apparatus of an electrophotographic type, an electrostatic recording type or the like, and particularly relates to an image forming apparatus including a large-sized operating portion, such as an operating panel.

A conventional image forming apparatus of the electrophotographic type has been widely used as a copying machine, a printer, a plotter, a facsimile machine, a multifunction machine having a plurality of functions of these machines, and the like. The image forming apparatus of this type is desired that an exclusive area is reduced particularly in an office environment, and therefore, a flat surface size thereof is decreased and the image forming apparatus is designed in a vertical type, so that the image forming apparatus of a type such that a discharge tray is not provided on a side surface of an apparatus main assembly but is provided in an in-body space has become widespread. In the image forming apparatus of this type, a liquid crystal display used in an operating panel is downsized, so that viewability of a sheet discharged onto an in-body discharge portion is improved in some instances.

On the other hand, in image forming apparatuses in recent years, the operating panel is upsized with multifunctionality, so that as a display panel, a wide-sized panel is used and thus usability is improved. A wide-sized liquid crystal display panel is mounted to an image forming apparatus particularly for consumers or for office use.

Further, as disclosed in Japanese Laid-Open Patent Application (JP-A) 2012-234102, an image forming apparatus has been developed in recent years having a universal design such that operations can be easily performed in either the case of a user in a standing attitude or a seated attitude, such as an attitude during use of a wheel chair. In this image forming apparatus, an operating portion exposed at a front surface of an apparatus main assembly is provided so as to be switchable between a normal operating (using) position and an operating position that is pulled out toward a front side. This operating portion is switchable between the two operating positions while a cable connecting the operating portion and a controller is electrically connected with those portions. In this image forming apparatus, a distance between the operating portion and the controller is different between the two operating positions, and therefore, during the use at the normal operating position, where the operating portion and the controller are close to each other, an excessive length of the cable is generated. Therefore, in the image forming apparatus, a cable winding-up mechanism is provided inside the operating portion, and the cable having the excessive length because of a difference of the two operating positions is wound up by the cable winding-up mechanism.

Incidentally, in a conventional image forming apparatus including a relatively small-sized operating portion, when an operation of mounting the operating portion to the apparatus main assembly during assembling of the image forming apparatus, an operator carries out an operation of connecting a cable from the controller with the operating portion by one hand while holding (supporting) the operating portion by the other hand.

However, in the above-described image forming apparatus disclosed in JP-A2012-234102, the operating panel of the operating portion is upsized and is increased in weight, and therefore, it was difficult for the operator to connect the cable with the operating portion by one hand while holding the operating portion by the other hand, so that there was a problem that operativity was poor. In order to solve this problem, it would be considered that an operation procedure in which the cable is connected with the operating portion in a state in which the operating portion is temporarily mounted on a jig or the like and then the operating portion is assembled with the apparatus main assembly is employed. However, in this operation procedure, the cable is connected with the operating portion in the state in which the operating portion is temporarily mounted on the jig or the like, and therefore, compared with the case where the cable is connected while holding the operating position by the hand as in the case of the conventional image forming apparatus, a necessary cable length becomes long. For this reason, during use of the image forming apparatus after the operating portion is mounted to the apparatus main assembly, an unnecessary excessive length of the cable is generated. In the above-described image forming apparatus disclosed in JP-A 2012-234102, the cable winding-up mechanism is provided inside the operating portion and when the cable having the excessive length generating due to the mounting operation is wound up by using the cable winding-up mechanism, the cable winding-up mechanism is upsized, so that the operating portion is further upsized.

SUMMARY OF THE INVENTION

The principal object of the present invention is to provide an image forming apparatus capable of suppressing further upsizing of an operating portion even when an excessive length of a cable generates, due to a mounting operation of the operating portion to an apparatus main assembly, with upsizing of the operating portion.

According to an aspect of the present invention, there is provide an image forming apparatus comprising: an apparatus main assembly; a controller provided in the apparatus main assembly; an operating portion mounted to the apparatus main assembly; a cable configured to electrically connect the controller and the operating portion, the cable having a connectable length with the operating portion mounted at a predetermined position; and an accommodating portion provided in the apparatus main assembly and configured to accommodate an excessive length portion of the cable connected with the operating portion mounted to the apparatus main assembly, the accommodating portion including a space for accommodating the cable which is wound.

Further features of the present invention will become apparent from the following description of exemplary embodiments with reference to the attached drawings.

DESCRIPTION OF EMBODIMENTS

<First Embodiment>

In the following, the First Embodiment of the present invention will be specifically described with reference to FIGS. 1 to 5. In this embodiment, as an example of an image forming apparatus, a full-color printer of a tandem type is described. However, the image forming apparatus in the present invention is not limited to the full-color printer of the tandem type but may also be an image forming apparatus of another type. Further, the image forming apparatus is not limited to the full-color image forming apparatus, but may also be an image forming apparatus for forming a monochromatic image or a mono-color image.

Figure 1:
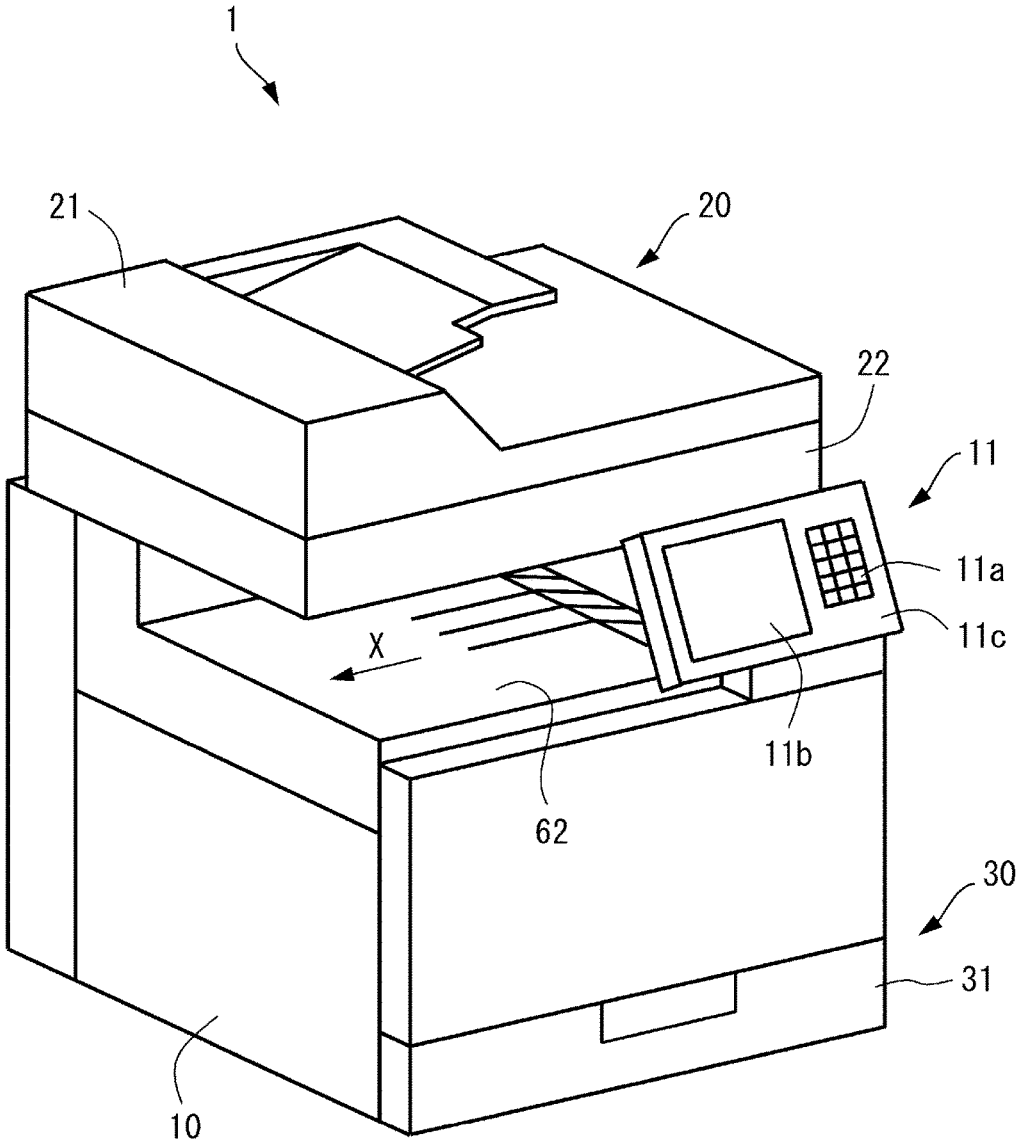
FIG. 1 is a perspective view showing a schematic structure of an image forming apparatus according to a First Embodiment of the present invention.

As shown in FIG. 1, an image forming apparatus 1 includes an image forming apparatus main assembly 10 as a casing. At a mounting portion 10*a* (FIG. 3) of a front surface portion, of the apparatus main assembly 10, positioned at an upper front portion, an operating panel (operating portion) 11 is mounted. The operating panel 11 is provided with operating buttons 11*a* and a display portion 11*b* capable of displaying a state of the image forming apparatus 1. Details of the operating panel 11 will be described later.

Figure 2:
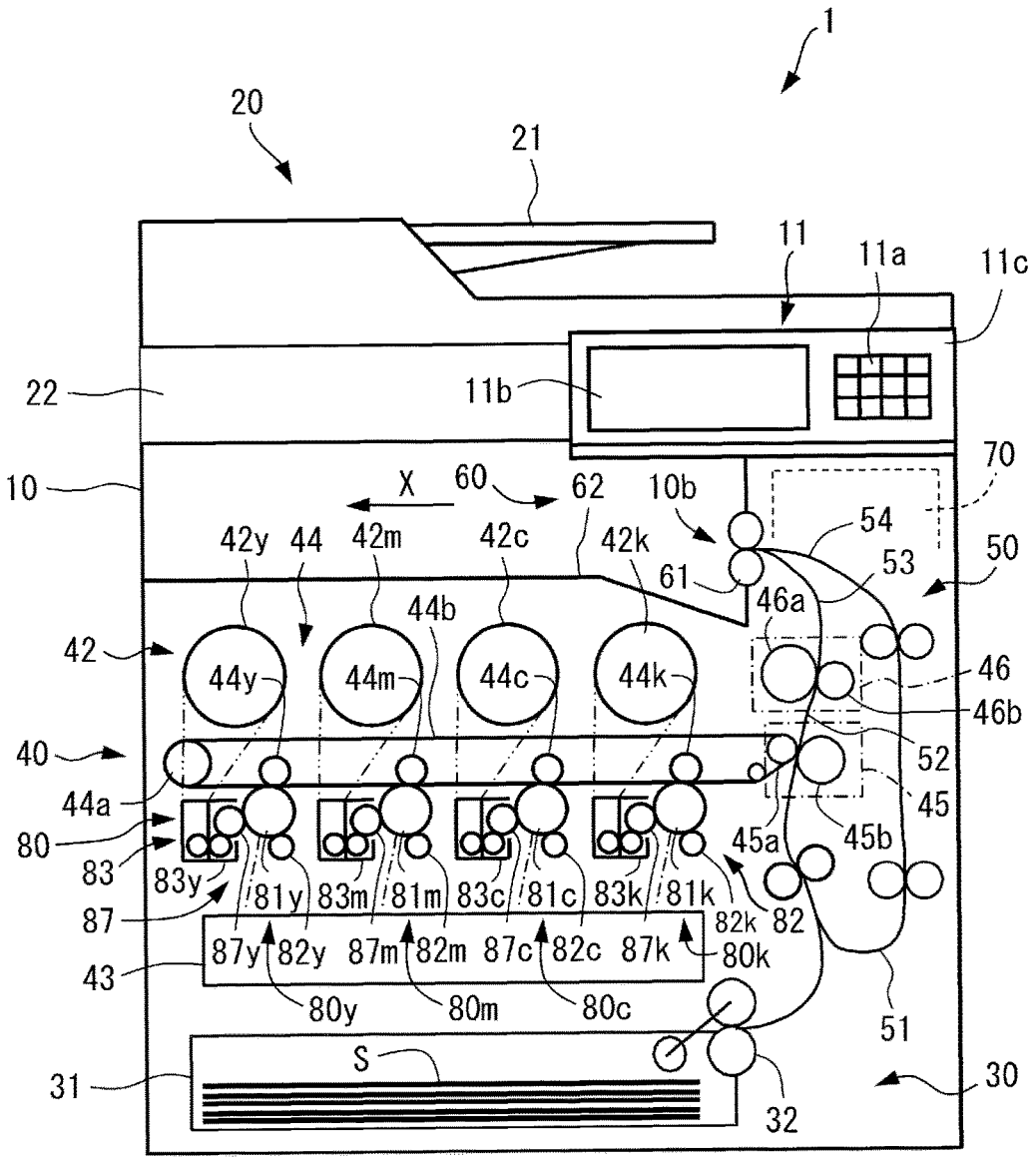
FIG. 2 is a schematic sectional view of the image forming apparatus in the First Embodiment.

As shown in FIG. 2, the apparatus main assembly 10 includes an image reading portion 20, a sheet feeding portion 30, an image forming portion 40, a sheet conveying portion 50, a sheet discharging portion 60, and a controller 70. On a sheet S as a recording material, a toner image is to be formed, and specific examples of the sheet S may include plain paper, a synthetic resin material sheet as a substitute for the plain paper, thick paper, a sheet for an overhead projector, an automatic document feeder 21, a base 22, and the like.

The image reading portion 20 is provided at an upper portion of the apparatus main assembly 10. The image reading portion 20 includes an unshown platen glass as an original carriage, an unshown light source for irradiating an original placed on the platen glass with light, an unshown image sensor for converting reflected light into a digital signal, an automatic document feeder 21, a base 22, and the like.

The sheet feeding portion 30 is disposed at a lower portion of the apparatus main assembly 10, and includes a sheet cassette 31 for stacking and accommodating the sheet S such as recording paper and includes a feeding roller 32. The sheet feeding portion 30 feeds the accommodated sheet S to the image forming portion 40.

The image forming portion 40 includes an image forming unit 80, a toner container 42, a laser scanner 43, an intermediary transfer unit 44, a secondary transfer portion 45 and a fixing device 46. The image forming portion 40 is capable of forming an image on the sheet S on the basis of image information. The image forming apparatus 1 in this embodiment is adapted to full-color image formation, and image forming units 80*y*, 80*m*, 80*c* and 80*k* for four colors of yellow (y), magenta (m), cyan (c) and black (k), respectively, have the same constitution and are separately provided. Also toner containers 42*y*, 42*m*, 42*c* and 42*k* for the four colors of yellow (y), magenta (m), cyan (c) and black (k), respectively, have the same constitution and are separately provided. For this reason, in FIG. 2, respective constituent elements for the four colors are represented by adding color identifiers to reverence numerals or symbols thereof, but in the specification, will be described using only the reference numerals or symbols without adding the color identifiers in some cases.

The toner containers 42*y*, 42*m*, 42*c* and 42*k* are cylindrical bottles, for example, in which toners are accommodated, and are disposed above the respective image forming units 80*y*, 80*m*, 80*c* and 80*k* via toner hoppers.

The image forming unit 80 includes a photosensitive drum 81*y*, 81*m*, 81*c* or 81*k* for forming a toner image, a charging roller 82, a developing device 83 and an unshown cleaning blade. In this embodiment, the image forming unit 80 is detachably mountable to the apparatus main assembly 10. Further, also as regards the photosensitive drum 81, the charging roller 82 and the developing device 83, the associated members or devices for the four colors of yellow (y), magenta (m), cyan (c) and black (k) have the same constitution and are separately provided.

The photosensitive drum 81 is rotated by an unshown drum motor and is circulated and moved while carrying an electrostatic latent image formed on the basis of image information during image formation. The charging roller 82 contacts a surface of the photosensitive drum 1 and electrically charges the photosensitive drum surface.

A developing sleeve 87 of the developing device 83 has a function of magnetically holding a developer inside a developing container by a magnet fixedly provided inside the developing sleeve 87 and then feeding the developer to a gap between itself and the photosensitive drum 81. With the developing sleeve 87, an unshown high-voltage source for applying a developing bias in the form of a DC voltage biased with an AC voltage is connected. The developing sleeve 87 executes a developing process by depositing the toner on the electrostatic latent image by the developing bias.

The laser scanner 43 exposes the surface of the photosensitive drum 81, charged by the charging roller 82, to light and forms the electrostatic latent image on the surfaces of the photosensitive drum 81.

The intermediary transfer unit 44 is disposed above the image forming unit 80. The intermediary transfer unit 44 includes a driving roller 44*a*, an unshown follower roller, a plurality of primary transfer rollers 44*y*, 44*m*, 44*c* and 44*k*, and the intermediary transfer belt 44*b* wound around there rollers. The primary transfer rollers 44*y*, 44*m*, 44*c* and 44*k* are disposed opposite to the photosensitive drums 81*y*, 81*m*, 81*c* and 81*k*, respectively, and are disposed in contact with the intermediary transfer belt 44*b*.

On the intermediary transfer belt 44*b*, at least a certain tension is exerted when the intermediary transfer belt 44*b* is not driven, so that the intermediary transfer belt 44*b* always contacts the photosensitive drums 81*y*, 81*m*, 81*c* and 81*k* without being spaced from the photosensitive drums 81*y*, 81*m*, 81*c* and 81*k*. A positive transfer bias is applied to the intermediary transfer belt 44*b* by the primary transfer rollers 44*y*, 44*m*, 44*c* and 44*k*, whereby toner images having a negative polarity are superposedly transferred successively from the photosensitive drums 81*y*, 81*m*, 81*c* and 81*k* onto the intermediary transfer belt 44*b*. As a result, a full-color toner image obtained by developing the electrostatic latent images on the surfaces of the photosensitive drums 81*y*, 81*m*, 81*c* and 81*k* is transferred on the intermediary transfer 44*b*, and the intermediary transfer belt 44*b* moves.

The secondary transfer portion 45 includes a secondary transfer inner roller 45*a* and a secondary transfer outer roller

45*b*. By applying a positive secondary transfer bias to the secondary transfer outer roller 45*b*, the full-color (toner) image formed on the intermediary transfer belt 44*b* is transferred onto the sheet S. The secondary transfer inner roller 45*a* stretches the intermediary transfer belt 44*b* at an inside of the intermediary transfer belt 44*b*, and the secondary transfer outer roller 45*b* is provided at a position opposing the secondary transfer inner roller 45*a* via the intermediary transfer belt 44*b*.

The fixing device 46 includes a fixing roller 46*a* and a pressing roller 46*a*. The sheet S is nipped and fed between the fixing roller 46*a* and the pressing roller 46*b*, so that the toner image transferred on the sheet S is pressed and heated to be fixed on the sheet S. The fixing device 46 constitutes a single unit and is insertable into and demountable from the apparatus main assembly 10.

The sheet conveying portion 50 includes a pre-secondary transfer feeding path 51, a pre-fixing feeding path 52, a discharging path 53, and a (re-)feeding path 54, and feeds the sheet S, fed from the sheet feeding portion 30, from the image forming portion 40 to the sheet discharging portion 60.

The sheet discharging portion 60 includes a discharging roller pair 61 provided in a downstream side of the discharging path 53 and includes a discharge tray 62 provided in a downstream side of the discharging roller pair 61. The discharging roller pair 61 feeds the sheet S, fed from a nip along the discharging path 53, to discharge the sheet S onto the discharge tray 62 through a discharge opening 10*b* formed in the apparatus main assembly 10. The discharge tray 62 is a face-down tray and stacks the sheets S discharged in an arrow X direction through the discharge opening 10*b*.

The controller 70 is accommodated at a rear portion of the apparatus main assembly 10 (FIG. 3) and constituted by a computer and includes, for example, a CPU, ROM for storing a program for controlling respective portions, RAM for temporarily storing data, and an input-and-output circuit for inputting and outputting signals relative to an external device. The controller 70 is connected via the input-and-output circuit with each of the image reading portion 20, the sheet feeding portion 30, the image forming portion 40, the sheet conveying portion 50, the sheet discharging portion 60 and the operating panel 11, and transfers signals with the respective portions and controls operations of the respective portions. Further, the controller 70 is capable of setting, for example, in a copying function, a copying sheet number, enlargement, reduction, density, double sides/single side, color/monochromatic, a sheet feeding cassette, a sheet size, and the like by an operation of the operating panel 11 or the like by a user.

An image forming operation in the image forming apparatus 1 constituted as described above will be described.

When the image forming operation is started, first, the photosensitive drum 81 is rotated, and the surface thereof is electrically charged by the charging roller 82. Then, the laser scanner 43 emits, on the basis of image information, laser light toward the surface of the photosensitive drum 81, so that the electrostatic latent image is formed on the surface of the photosensitive drum 81. The toner is deposited on the electrostatic latent image to develop (visualize) the electrostatic latent image into a toner image, and then the toner image is transferred onto the intermediary transfer belt 44*b*.

On the other hand, in parallel to such a toner image forming operation, the feeding roller 32 is rotated to feed the uppermost sheet S in a sheet cassette 31 while separating the sheet S. Then, the sheet S is fed to the secondary transfer portion 45 via the pre-secondary transfer feeding path 51 by being timed to the toner image on the intermediary transfer belt 44*b*. Then, the toner image is transferred from the intermediary transfer belt 44*b* onto the sheet S, and the sheet S is fed into the fixing device 46, in which the (unfixed) toner image is heated and pressed, thus being fixed on the surface of the sheet S. The sheet S is discharged by the discharging roller pair 61 through the discharge opening 10*b*, so that the sheet S is stacked on the discharge tray 62.

Next, a constitution of a connecting portion, by a wire harness 71, between the apparatus main assembly 10 and the operating panel 11 of the above-described image forming apparatus 1 will be described specifically using FIGS. 3-5.

The operating panel 11 includes an operating portion main body 11*c* and a supporting portion 11*d* for supporting the operating portion main body 11*c* tiltably with respect to a vertical (up-down) direction relative to a mounting portion 10*a* of the apparatus main assembly 10. The operating portion main body 11*c* includes the operating buttons 11*a*, the display portion 11*b* and an unshown connector for connecting an end portion connector of the wire harness 71. The supporting portion 11*d* has a hinged structure and connects the operating portion main body 11*c* and the mounting portion 10*a* of the apparatus main assembly 10 so as to be tiltable with respect to the vertical direction.

Figure 3:
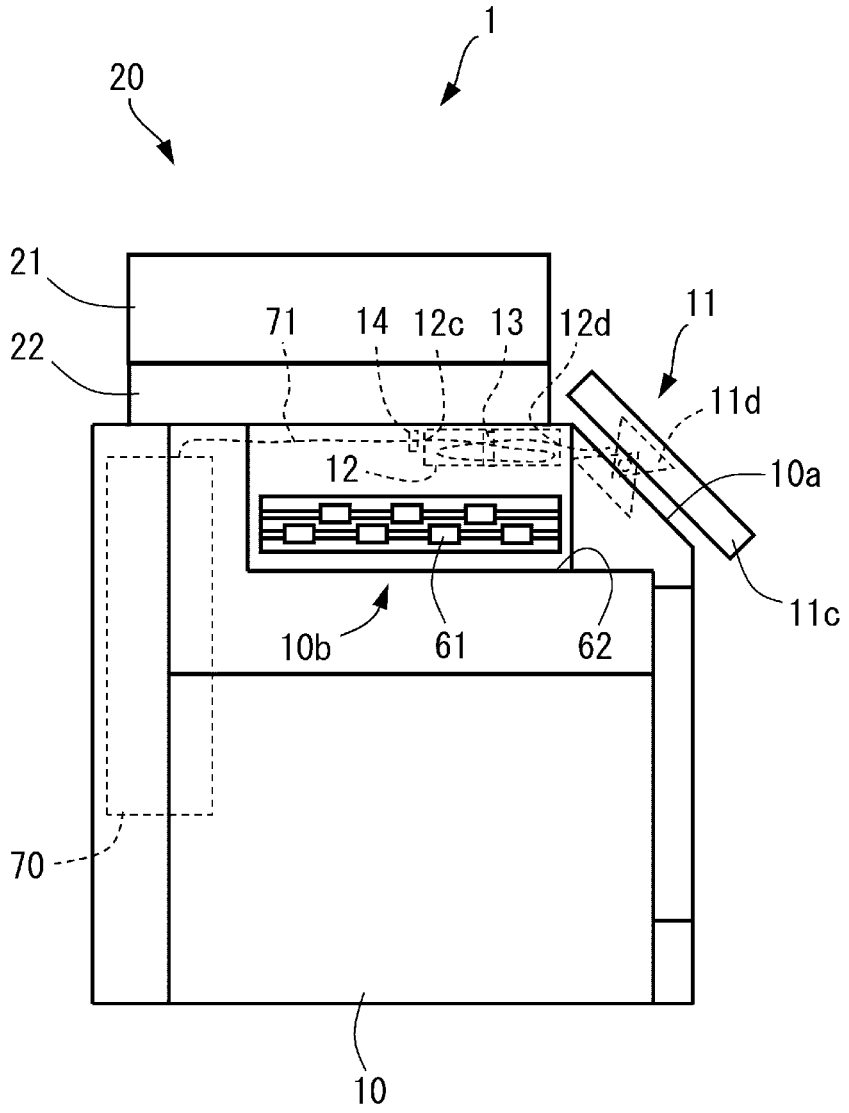
FIG. 3 is a schematic side view of the image forming apparatus in the First Embodiment.

The wire harness 71 is constituted by a bundle wire including a plurality of cables bundled and connectors provided at end portions thereof, and electrically connects the controller 70 and the operating panel 11 as shown in FIG. 3. The wire harness 71 is wired between the image reading portion 20 and the discharging roller pair 61.

The apparatus main assembly 10 includes an accommodating portion 12 in which the wire harness 71 is accommodatable, a winding shaft 13 about which the wire harness 71 accommodated in the accommodating portion 12 is wound, and a controller-side fixing portion 14. The controller-side fixing portion 14 fixes, inside the apparatus main assembly 10, the wire harness 71 extending from the winding shaft 13 toward the controller 70.

Figure 4:
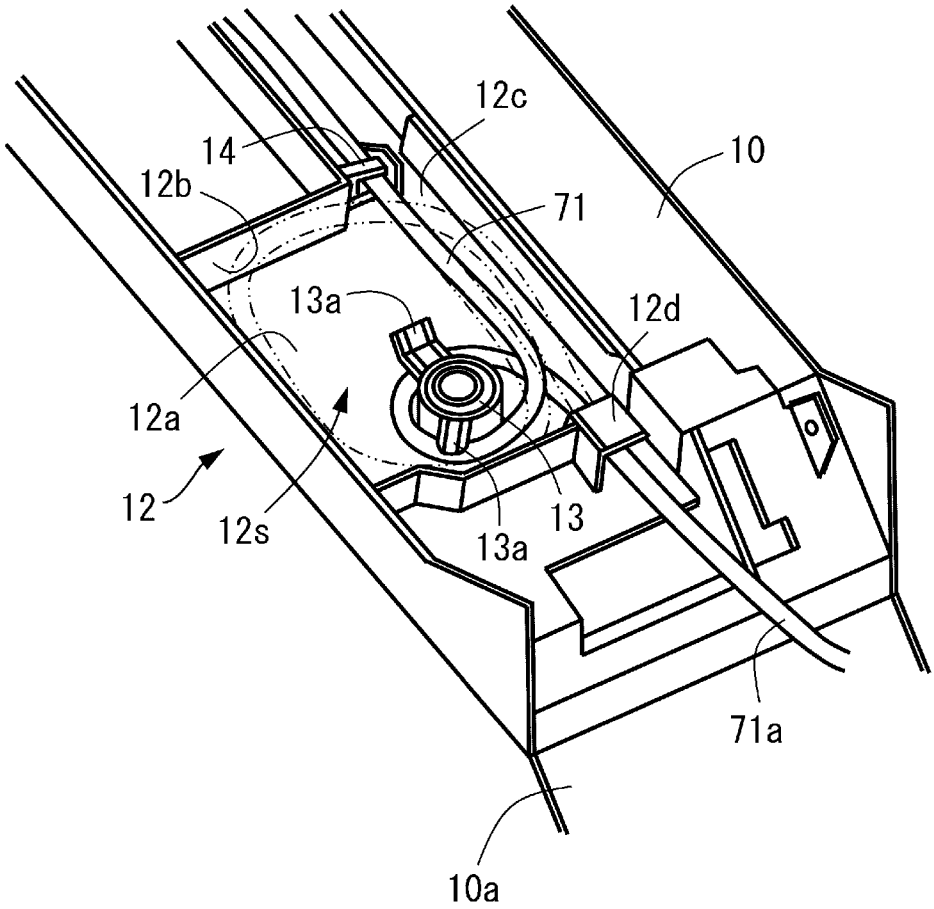
FIG. 4 is an illustration showing an accommodating portion in which a wire harness of the image forming apparatus in the First Embodiment is accommodated.

The accommodating portion 12 is provided between the image reading portion 20 and the discharging roller pair 61 and includes a bottom 12*a*, a side wall portion 12*b* and an unshown upper wall portion as shown in FIG. 4. Further, the accommodating portion 12 includes a controller-side port 12*c* provided at a part of the side wall portion 12*b* in a controller 70 side so as to be adjacent to the controller-side fixing portion 14 and an operating portion-side port 12*d* provided at a part of the side wall portion 12*b* in an operating panel 11 side. The accommodating portion 12 includes a space 12*s*, defined by the bottom 12*a*, the side wall portion 12*b* and the upper wall portion, in which the wire harness 71 having a predetermined length ranging from the controller-side fixing portion 14 toward the operating panel 11 is accommodatable. The sheet 71 connects an inside and an outside of the accommodating portion 12 through the controller-side port 12*c* and the operating portion-side port 12*d*.

Figure 5:
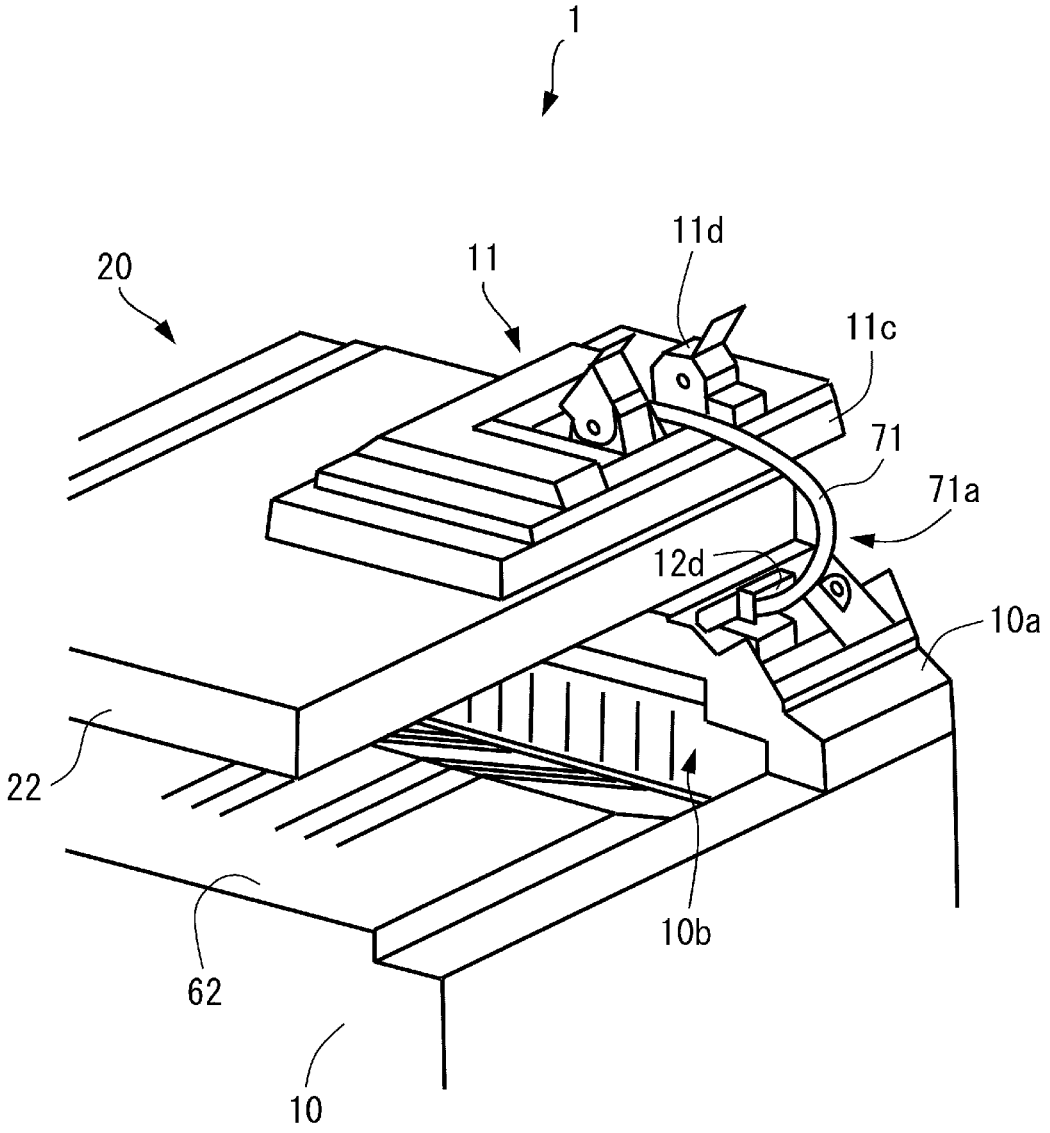
FIG. 5 is a perspective view showing a state during a mounting operation of an operating panel of the image forming apparatus in the First Embodiment.

Here, as shown in FIG. 5, during an operation of mounting the operating panel 11 to the apparatus main assembly 10, the operator connects the operating panel 11, in a state (predetermined position) in which the operating panel 11 is temporarily placed on the base 22 of the image reading portion 20, with the controller 70. Thereafter, the operator mounts the operating panel 11 to the apparatus main assembly 10, so that an excessive length (portion) 71*a* of the wire harness 71 is generated. In this embodiment, in the accommodating portion 12, the wire harness 71 having a length corresponding to the thus-generated excessive length 71*a* is accommodatable. That is, the accommodating portion 12 is capable of accommodating the wire harness 71 in a necessary length (excessive length 71*a*) in a state in which the operating panel 11 is placed in the predetermined position different from a mounting position thereof to the apparatus main assembly 10.

Further, of the wire harness 71, at the excessive length portion 71*a* extending from the apparatus main assembly 10 to an outside through the operating portion-side port 12*d*, a plurality of cable portions are bundled into a single cable with a tape or the like. That is, in the state in which the operating panel 11 is temporarily placed on the image reading portion 20, of the plurality of cable portions constituting the wire harness 71, at least the portions exposed to the outside of the apparatus main assembly 10 are bundled.

As shown in FIG. 4, the winding shaft 13 is provided so as to project from the bottom 12*a* toward an inside of the accommodating portion 12. About the winding shaft 13, the wire harness 71 is wound by one turn (full circumference). For this reason, the wire harness 71 connected with the controller 70 and pulled and moved enters the accommodating portion 12 through the controller-side port 12*c*, and is wound about the winding shaft 13 by one turn with a gap in a radial direction from the winding shaft 13, and then is connected with the operating panel through the operating portion-side port 12*d*. In the state in which the operating panel 11 is temporarily placed on image reading portion 20, the wire harness 71 is pulled and wound around the winding shaft 13 (solid line in FIG. 4). On the other hand, in a state in which the operating panel 11 is mounted to the apparatus main assembly 10, the wire harness 71 is loosely wound around the winding shaft 13 (a chain double-dashed line in FIG. 4).

At a free end portion of the winding shaft 13, two flange-shaped regulating portions 13*a* extending in the radial direction are provided with an interval of about 120° C. with respect to a circumferential direction of the winding shaft 13. In this embodiment, the regulating portions 13 are provided with the interval of about 120° C. with respect to the circumferential direction, but are not limited thereto and may also be provided with an appropriate interval. Further, the number of the regulating portions 13 is not limited to two but may also be one or three or more. A length of the regulating portions 13 in the radial direction is set at a length to the extent that the cable forming the wire harness 71 wound around the winding shaft 13 is prevented from being unbundled and disconnected, and may preferably be a length to the extent that it is slightly longer than a diameter of the wire harness 71, for example. As a result, the regulating portions 13*a* can regulate the wound wire harness 71 so as not to be unbundled into the cable portions to be prevented from being disconnected from the winding shaft 13.

Next, a procedure of mounting the operating panel 11 to the apparatus main assembly 10 in the above-described image forming apparatus 1 will be described along FIGS. 4 and 5. Incidentally, before the operating panel 11 is mounted to the apparatus main assembly 10, as shown in FIG. 4, the wire harness 71 is connected with the controller 70 and is fixed at the controller-side fixing portion 14, and then is pulled into the accommodating portion 12 through the controller-side port 12*c* and is accommodated in the accommodating portion 12. Then, the wire harness 71 accommodated in the accommodating portion 12 is wound one full turn about the winding shaft 13 and then is exposed to the outside of the apparatus main assembly 10 through the operating portion-side port 12*d*.

The operating panel 11 in this embodiment includes the display portion 11*b* (FIG. 1) which is upsized and is heavy in weight, and therefore the operation of assembling the wire harness 71 while holding the operating panel 11 with one hand of the operator as in the case of the conventional image forming apparatus is very unstable and it is difficult to perform the operation. Therefore, as shown in FIG. 5, the operating panel 11 assembled into a unit in advance in temporarily placed once on the base 22 of the image reading portion 20. The operator connects the connector, positioned at the free end of the wire harness 71 extending from the apparatus main assembly 10, with the connector of the operating panel 11 in the temporarily placed state. At this time, the wire harness 71 has a sufficient excessive length 71*a* to the extent that the wire harness 71 can be connected with the temporarily placed operating panel 11 with no load. As a result, the connecting operation of the wire harness 71 with the operating panel 11 can be easily carried out. Further, the excessive length 71*a* portions are bundled into a single cable, and therefore, operativity is good compared with the case where the excessive length 71*a* portions are not bundled.

At this time, the bundled excessive length 71*a* portion of the wire harness 71 is exposed to the outside of the apparatus main assembly 10, and as shown in FIG. 4, the wire harness 71 is pulled and wound about the winding shaft 13. At this time, the wire harness 71 is fixed inside the apparatus main assembly 10 at the controller-side fixing portion 14, and therefore, even when the wire harness 71 is pulled from the outside of the apparatus main assembly 10, disconnection of the wire harness 71 from the controller 70 is suppressed. Further, the wire harness 71 is wound about the winding shaft 13, and therefore, compared with the case where the wire harness 71 is not wound about the winding shaft 13, it is possible to suppress entanglement of the wire harness 71.

After the connection of the wire harness 71, the operator mounts the operating panel 11 to the mounting portion 10*a* of the apparatus main assembly 10. In this embodiment, the supporting portion 11*d* is mounted to the mounting portion 10*a* of the apparatus main assembly 10. At that time, the operator inserts the excessive length portion 71*a*, of the wire harness 71 exposed to the outside of the apparatus main assembly 10, into the accommodating portion 12 through the operating portion-side port 12*d*. As a result, inside the accommodating portion 12, the wire harness 71 wound about the winding shaft 13 is increased in a winding radius and is loosely wound around the winding shaft 13 with an increased gap from the winding shaft 13 with respect to the radial direction. The wire harness 71 increased in winding radius can freely extend in the space 12*s* formed inside the accommodating portion 12 by being extended along and in contact with the side wall portion 12*b* or by being bent and projected from the side wall portion 12*b* toward the inside of the accommodating portion 12.

Further, the wire harness 71 is wound around the winding shaft 13, and therefore, compared with the case where the wire harness 71 is not wound around the winding shaft 13, it is possible to suppress entanglement of the wire harness 71. For this reason, the excessive length portion 71*a* of the wire harness 71 is smoothly accommodated in the accommodating portion 12, and the operating panel 11 is mounted to the mounting portion 10*a* of the apparatus main assembly 10. Here, the wire harness 71 is fixed inside the apparatus main assembly 10 by the controller-side fixing portion 14. For this reason, even when the wire harness 71 is pushed from the outside of the apparatus main assembly 10 into the accommodating portion 12, the wire harness 71 is prevented from entering the controller 70 side from the accommodating portion 12 side.

After the mounting of the operating panel 11 to the apparatus main assembly 10, the operating portion main body 11*c* is supported by the supporting portion 11*d* so as to be tiltable with respect to the vertical direction. With this tilting, the wire harness 71 accommodated in the accommodating portion 12 slightly moves into and out of the accommodating portion 12, so that prevention of the tilting is prevented.

As described above, according to the image forming apparatus 1 of this embodiment, the apparatus main assembly 10 includes the accommodating portion 12 and the winding shaft 13. Further, the accommodating portion 12 is capable of accommodating the necessary excessive length portion 71*a* of the sheet 71 in the state in which the operating panel 11 is temporarily placed on the image reading portion 20 during the operation of mounting the operating panel 11 to the apparatus main assembly 10. During the assembling of the image forming apparatus 1, in order to connect the wire harness 71 with the operating panel 11 in a state in which the operating panel 11 is temporarily placed on the jig or the like due to the upsizing of the operating panel 11, the excessive length portion 71*a* of the wire harness 71 generates after the mounting of the operating panel 11 in some instances. According to this image forming apparatus 1, the excessive length portion 71*a* can be accommodated in the accommodating portion 12. As a result, with the upsizing of the operating panel 11, even when the excessive length portion 71*a* of the wire harness 71 generates in order to perform the mounting operation of the operating panel 11 to the apparatus main assembly 10, it is possible to suppress further upsizing of the operating panel 11.

Further, according to the image forming apparatus 1 of this embodiment, the accommodating portion 12 is provided with the winding shaft 13, and therefore, the wire harness 71 can be accommodated in the accommodating portion 12 in the wound state around the winding shaft 13. As a result, compared with the case where the winding shaft 13 is not provided, the entanglement of the wire harness 71 can be suppressed, and therefore, the wire harness 71 can be smoothly accommodated in the accommodating portion 12.

Further, according to the image forming apparatus 1 of this embodiment, the controller-side fixing portion 14 for fixing the wire harness 71 to the apparatus main assembly 10 in a side where the wire harness 71 extends from the accommodating portion 12 toward the controller 70 side. For this reason, the wire harness 71 is prevented from not only be disconnected from the controller 70 even when the sheet 71 is pulled from the outside of the apparatus main assembly 10 but also entering the controller 70 side even when the wire harness 71 is pushed from the outside of the apparatus main assembly 10 toward the controller 70 side. As a result, it is possible to prevent improper connection between the controller 70 and the wire harness 71.

Further, according to the image forming apparatus 1 of this embodiment, the winding shaft 13 is provided with the regulating portions 13*a*, and therefore, it is possible to regulate the wire harness 71 so as not to be disconnected from the winding shaft 13 by being unbundled into the cable portions. As a result, the wire harness 71 is wound around the winding shaft 13 with reliability, and therefore, the entanglement of the wire harness 71 is suppressed, so that the wire harness 71 can be smoothly accommodated in the accommodating portion 12.

In the above-described image forming apparatus 1, the case where a plurality of cable portions connecting the operating panel 11 and the controller 70 are bundled into the wire harness 71 was described, but the present invention is not limited thereto. For example, the plurality of cable portions connecting the operating panel 11 and the controller 70 are not necessarily be required to be bundled, or the operating panel 11 and the controller 70 may also be connected by a single cable.

Further, in the image forming apparatus 1 of this embodiment, the case where the winding shaft 13 is provided with the regulating portions 13*a* was described, but the present invention is not limited thereto, and the regulating portions 13 may also be not provided. In this case, for example, when the winding shaft 13 has a length such that the winding shaft 13 extends from the bottom 12*a* of the accommodating portion 12 and reaches the upper wall portion of the accommodating portion 12, disconnection of the wire harness 71 from the winding shaft 13 can be prevented.

<Second Embodiment>

Next, the Second Embodiment of the present invention will be described specifically with reference to FIGS. 6 and 7. This embodiment is different in constitution from the First Embodiment in that an operating panel 111 is larger in size than that of the First Embodiment and in that the operating panel 111 is slidable and movable in a left-right direction. However, other constituent elements are similar to those in First Embodiment, and therefore, are represented by the same reference numerals or symbols and will be omitted from description.

Figure 6:
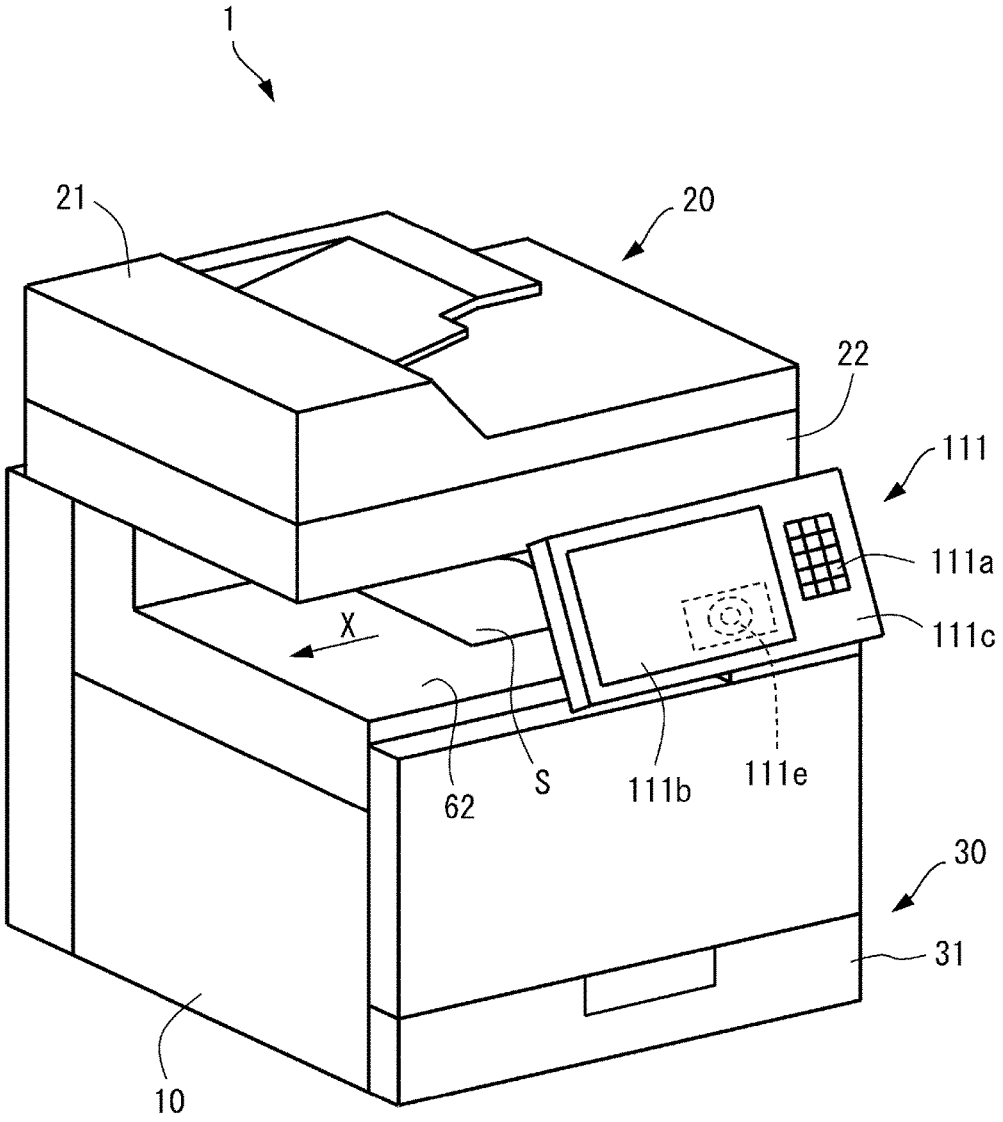
FIG. 6 is a perspective view showing a schematic structure of an image forming apparatus according to a Second Embodiment.

As shown in FIG. 6, an image forming apparatus 1 includes the operating panel 111 larger than the operating panel 11 in First Embodiment, so that compared with First Embodiment, an operating property of the user (operator) can be improved. On the other hand, the operating panel 111 is large in size, and therefore, there is a possibility that viewability of the sheet S discharged onto the in-body discharge tray 62. For that reason, the operating panel 111 includes an operating portion main body 111*c* and a supporting portion 111*d* for supporting the operating portion main body 111*c* tiltably with respect to a vertical (up-down) direction and slidably (movably) in the left-right direction relative to a mounting portion 10*a* of the apparatus main assembly 10. The operating portion main body 111*c* includes the operating buttons 111*a*, the display portion 111*b* and an unshown connector for connecting an end portion connector of the wire harness 71. The supporting portion 111*d* has a hinged structure and a slidable structure and connects the operating portion main body 111*c* and the mounting portion 10*a* of the apparatus main assembly 10 so as to be tiltable with respect to the vertical direction and slidable in the left-right direction.

The operating portion main body 111*c* is slidable and movable in the left-right direction, and therefore, the wire harness 71 is required to have a corresponding excessive length. For this reason, the operating portion main body 111*c* includes an accommodating device 111*e* capable of accommodating the excessive length portion for permitting the sliding movement. That is, the accommodating device 111*e* accommodates the wire harness 71 so as to be movable into and out of the accommodating device 111*e* when the operating portion main body 111*c* is moved relative to the apparatus main assembly 10. In this embodiment, as the accommodating device 111*e*, it is possible to employ a known cable winding mechanism or an appropriate new cable winding mechanism.

Here, as regards the wire harness 71 in this embodiment, there are two types of excessive length portions consisting of the excessive length portion during the mounting and the excessive length portion for permitting the sliding movement of the operating portion main body 111*c*. The excessive length portion during the mounting is provided so as to be accommodated in the accommodating portion 12, and the excessive length portion for permitting the sliding movement of the operating portion main body 111*c* is provided so as to be accommodated in the accommodating device 111*e*. However, for example, when the excessive length portion during the mounting is accommodated in the accommodating device 111*e* or when the excessive length portion per permitting the sliding movement of the operating portion main body 111*c* is accommodated in the accommodating portion 12, there is a liability of generation of improper movement or the like of the operating portion main body 111*c*.

Therefore, in this embodiment, an operating portion-side fixing portion 15 for fixing the wire harness 71 to the apparatus main assembly 10 is provided, as a part of the supporting portion 111*d* mounted to the mounting portion 10*a* of the apparatus main assembly 10, at a portion adjacent to a portion outside the operating portion-side port 12*d*. That is, the apparatus main assembly 10 includes the operating portion-side fixing portion 15 for fixing the wire harness 71 to the apparatus main assembly 10 in a side where the wire harness 71 extends from the winding shaft 13 toward the operating panel 11 side. As a result, it is possible to suppress the improper movement or the like of the operating portion main body 111*c* by preventing the accommodation of the excessive length portion, during the mounting, in the accommodating device 111*e* and the accommodation of the excessive length portion, for permitting the sliding movement, in the accommodating portion 12.

Figure 7:
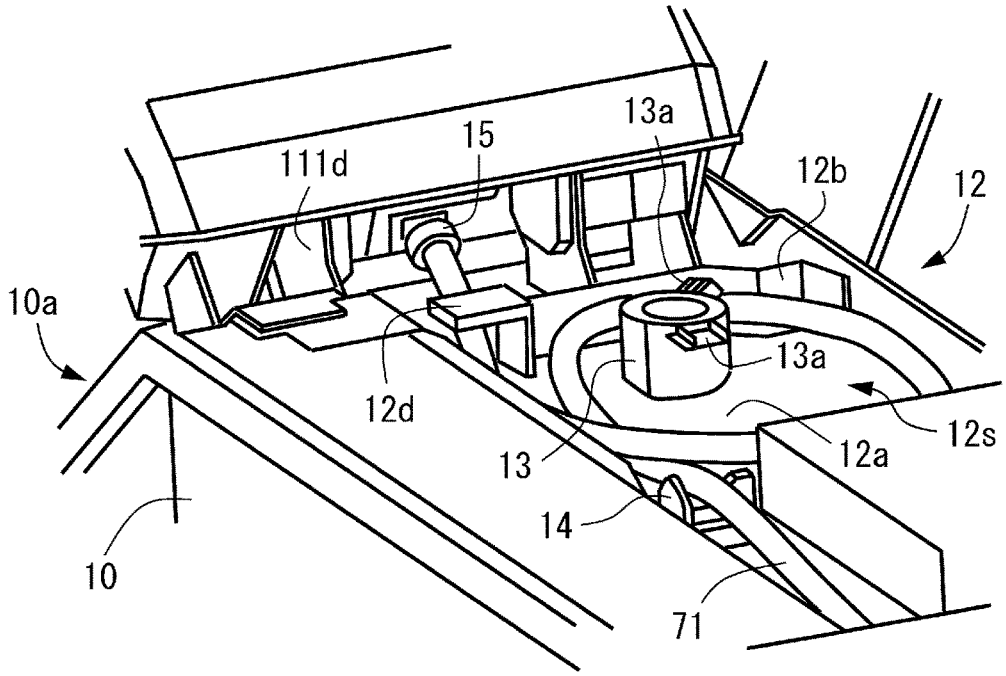
FIG. 7 is an illustration showing an accommodating portion in which a wire harness of the image forming apparatus in the Second Embodiment is accommodated.

In the above-described image forming apparatus 1, when the operating panel 111 is mounted to the apparatus main assembly 10, after the connection of the wire harness 71 to the operating panel 111, the operator mounts the supporting portion 111*d* of the operating panel 111 to the mounting portion 10*a* of the apparatus main assembly 10 as shown in FIG. 7. At that time, the operator inserts the excessive length portion 71*a* (FIG. 5), of the wire harness 71 exposed to the outside of the apparatus main assembly 10, into the accommodating portion 12 through the operating portion-side port 12*d*, and fixes the wire harness 71 at the operating portion-side fixing portion 15 of the supporting portion 111*d*. As a result, the wire harness 71 is fixed to the apparatus main assembly 10 in the side where the wire harness 71 extends from the winding shaft 13 toward the operating panel 111 side.

After the mounting of the operating panel 111 to the apparatus main assembly 10, the operating portion main body 111*c* is supported by the supporting portion 111*d* so as to be tiltable with respect to the vertical direction and slidable in the left-right direction. With the sliding movement of the operating portion main body 111*c*, the excessive length portion, of the wire harness 71, for permitting the sliding movement of the sheet 71 moves into and out of the accommodating device 111*c*, so that the sliding movement is carried out smoothly.

As described above, also by the image forming apparatus 1 of this embodiment, the excessive length portion 71*a* of the wire harness 71 during the mounting of the operating panel 111 can be accommodated in the accommodating portion 12 of the apparatus main assembly 10. As a result, with the upsizing of the operating panel 111, even when the excessive length portion 71*a* of the wire harness 71 generates in order to perform the mounting operation of the operating panel 111 to the apparatus main assembly 10, it is possible to suppress further upsizing of the operating panel 111.

Further, according to the image forming apparatus 1 of this embodiment, the operating panel 111 includes the accommodating device 111*e* for accommodating the wire harness 71 so as to be movable into and out of the accommodating device 111*e* when the operating portion main body 111*c* is moved relative to the apparatus main assembly 10. Further, the apparatus main assembly 10 includes the operating portion-side fixing portion 15 for fixing the wire harness 71 to the apparatus main assembly 10 in the side where the wire harness 71 extends from the winding shaft 13 toward the operating panel 111 side. As a result, it is possible to suppress the generation of the improper movement or the like of the operating portion main body 111*c* by preventing the accommodation of the excessive length portion, during the mounting, in the accommodating device 111*e* and the accommodation of the excessive length portion, for permitting the sliding movement, in the accommodating portion 12.

According to the present invention, the apparatus main assembly includes the accommodating portion and the winding shaft, and the mounting portion is capable of accommodating the cable having a necessary length in a state in which the operating portion is placed at a predetermined position different from the mounting position thereof to the apparatus main assembly. For this reason, during the assembling of the image forming apparatus, in order to connect the cable to the operating portion in the state in which the operating portion is placed on the jig or the like due to the upsizing of the operating portion, even when the excessive length portion of the cable generated after the mounting of the operating portion, the excessive length portion of the cable can be accommodated in the apparatus main assembly side. As a result, even when the excessive length portion of the cable for permitting the mounting of the operating portion to the apparatus main assembly generates due to the upsizing of the operating portion, it is possible to suppress further upsizing of the operating portion.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-106744 filed on May 27, 2016, which is hereby incorporated by reference herein in its entirety.

What is claimed is:

1. An image forming apparatus comprising:

a main assembly;

an image forming portion provided inside said main assembly and configured to form an image on a sheet;

an image reading device provided on said main assembly and including a reading portion configured to read an image on a sheet;

a sheet discharging portion provided in said main assembly and configured to discharge the sheet on which the image is formed by said image forming portion, wherein said sheet discharging portion is positioned below said image reading device with respect to a vertical direction;

a controller provided in said main assembly and disposed on a side closer to a rear surface of said image forming apparatus than said image forming portion is;

an operating panel mounted to said main assembly and disposed on a side closer to a front surface of said image forming apparatus than said image reading device is;

a cable configured to electrically connect said controller and said operating panel; and an accommodating portion provided in said main assembly between said image reading device and said sheet discharging portion with respect to the vertical direction and configured to form a space for accommodating said cable in a state in which said cable forms a loop, wherein said accommodating portion includes an opening configured to permit passing of said cable in the space to an outside of said main assembly and accommodates said cable in the space so that a size of the loop changes depending on a position of said operating panel, connected by said cable, relative to said main assembly and so that a length of said cable from said opening to said operating panel changes depending on a change of the size of the loop.

2. An image forming apparatus according to claim 1, further comprising a winding shaft formed in the space and about which said cable is wound.

3. An image forming apparatus according to claim 2, wherein said cable includes a plurality of cable portions, and wherein said winding shaft includes a regulating portion configured to regulate the wound cable so as not to be disconnected.

4. An image forming apparatus according to claim 3, wherein said regulating portion projects in a radial direction of said winding shaft, and wherein said winding shaft includes another regulating portion which is provided with an interval of about 120° from said regulating portion with respect to a circumferential direction of the winding shaft and which projects in the radial direction of said winding shaft.

5. An image forming apparatus according to claim 1, further comprising a supporting portion configured to support said operating panel movably relative to said main assembly, wherein said operating panel includes another accommodating portion configured to accommodate said cable so as to be movable into and out of said other accommodating portion when said operating panel is moved relative to said main assembly.

6. An image forming apparatus according to claim 1, wherein the size of the loop in a state in which said operating panel is demounted from a mounting portion of said main assembly and is mounted at a predetermined position is smaller than the size of the loop in a state in which said operating panel is mounted in the mounting portion, and wherein a distance between said operating panel and said opening at the predetermined position is longer than a distance between said opening and said operating panel mounted in the mounting position.

7. An image forming apparatus according to claim 6, wherein said image reading device includes (i) a base including said reading portion and (ii) an original feeding portion provided on said base with respect to the vertical direction, and wherein at the predetermined position, said operating panel is temporarily placed on an upper surface of said base when an operation is carried out after said operating panel is demounted from the mounting portion of said main assembly.

8. An image forming apparatus according to claim 7, wherein said base includes a platen glass on which an original from which the image is read by said reading portion is placed, and wherein at the predetermined position, said operating panel is temporarily placed on an upper surface of said platen glass when the operation is carried out after said operating panel is demounted from said main assembly.

9. An image forming apparatus according to claim 1, further comprising a fixing portion provided on said controller side of said accommodating portion and configured to fix said cable inside said main assembly, wherein said cable is connected with said operating panel through said opening and is accommodated in said accommodating portion in a state in which the loop is formed between said fixing portion and said opening.

10. An image forming apparatus according to claim 1, wherein said sheet discharging portion includes a discharging roller configured to discharge the sheet, on which the image is formed, to an outside of said image forming apparatus and includes a stacking tray on which sheets discharged by said discharging roller are to be stacked, and wherein said accommodating portion is provided between said image reading device and said discharging roller with respect to the vertical direction.

11. An image forming apparatus comprising:

a main assembly;

an image forming portion provided inside said main assembly and configured to form an image on a sheet;

an image reading device provided on said main assembly and including a reading portion configured to read an image on a sheet;

a sheet discharging portion provided in said main assembly and configured to discharge the sheet on which the image is formed by said image forming portion, wherein said sheet discharging portion is positioned below said image reading device with respect to a vertical direction;

a controller provided in said main assembly and on a side closer to a rear surface of said image forming apparatus than said image forming portion is;

an operating panel mounted to said main assembly and on a side closer to a front surface of said image forming apparatus than said image reading device is;

a cable configured to electrically connect said controller and said operating panel; and an accommodating portion provided in said main assembly between said image reading device and said sheet discharging portion with respect to the vertical direction and configured to form a space for accommodating said cable in a state in which said cable forms a loop, wherein said accommodating portion includes an opening configured to permit passing of said cable in the space to an outside of said main assembly and accommodates said cable so that a size of the loop in a state in which said operating panel is positioned at a predetermined position where said operating panel is demounted from said main assembly and mounted on said image reading device is smaller than a size of the loop in a state in which said operating panel is positioned at a mounting position where said operating panel is mounted to said main assembly, and wherein a distance between said operating panel and said opening at the predetermined position is longer than a distance between said opening and said operating panel mounted in the mounting position.

12. An image forming apparatus according to claim 11, wherein said image reading device includes (i) a base including said reading portion and (ii) an original feeding portion provided on said base with respect to the vertical direction, and wherein at the predetermined position, said operating panel is temporarily placed on an upper surface of said base when an operation is carried out after said operating panel is demounted from the mounting portion of said main assembly.

13. An image forming apparatus according to claim 12, wherein said base includes a platen glass on which an original from which the image is read by said reading portion is placed, and wherein at the predetermined position, said operating panel is temporarily placed on an upper surface of said platen glass when the operation is carried out after said operating panel is demounted from said main assembly.

14. An image forming apparatus according to claim 11, further comprising a winding shaft formed in the space and about which said cable is wound, wherein said cable includes a plurality of cable portions, and wherein said winding shaft includes a regulating portion configured to regulate the wound cable so as not to be disconnected.

15. An image forming apparatus according to claim 14, wherein said regulating portion projects in a radial direction of said winding shaft, and wherein said winding shaft includes another regulating portion which is provided with an interval of about 120° from said regulating portion with respect to a circumferential direction of the winding shaft and which projects in the radial direction of said winding shaft.

16. An image forming apparatus according to claim 11, further comprising a fixing portion provided on said controller side of said accommodating portion and configured to fix said cable inside said main assembly, wherein said cable is connected with said operating panel through said opening and is accommodated in said accommodating portion in a state in which the loop is formed between said fixing portion and said opening.

17. An image forming apparatus according to claim 11, wherein said sheet discharging portion includes a discharging roller configured to discharge the sheet, on which the image is formed, to an outside of said image forming apparatus and includes a stacking tray on which sheets discharged by said discharging roller are to be stacked, and wherein said accommodating portion is provided between said image reading device and said discharging roller with respect to the vertical direction.

* * * * *